United States Patent [19]

Houde-Walter

[11] Patent Number: 4,934,086

[45] Date of Patent: Jun. 19, 1990

[54] RECOIL SPRING GUIDE MOUNTING FOR LASER SIGHT

[76] Inventor: William R. Houde-Walter, 6902 E. River Rd., Rush, N.Y. 14543

[21] Appl. No.: 331,905

[22] Filed: Mar. 31, 1989

[51] Int. Cl.[5] ..... F41G 1/35

[52] U.S. Cl. ..... 42/103; 362/110

[58] Field of Search ..... 42/103; 362/110–114

[56] References Cited

U.S. PATENT DOCUMENTS

| | | | |
|---|---|---|---|
| 1,452,651 | 4/1923 | Norrlin | 362/110 |
| 3,513,581 | 5/1970 | Slater | 42/103 |
| 3,573,868 | 4/1971 | Giannetti | 42/103 |
| 4,026,054 | 5/1977 | Snyder | 362/110 |
| 4,161,076 | 7/1979 | Snyder | 42/103 |
| 4,627,183 | 12/1986 | Stuckman | 362/110 |

OTHER PUBLICATIONS

Advertisement sheet on Lasersight LS45 Laser Aiming System, by Imatronic Inc.

Advertisement sheet on SURE-FIRE, by Laser Products.

Advertisement sheet entitled "A New Age of Lasersight Technology", by Gryphon Electronics Inc.

Advertisement sheet, by American Made Mounts.

Four advertisement sheets on Aimtech pistol mounts, by L & S Technologies, Inc.

*Primary Examiner*—Charles T. Jordan

*Assistant Examiner*—Michael J. Carone

*Attorney, Agent, or Firm*—Stonebraker, Shepard & Stephens

[57] ABSTRACT

A laser sight for a firearm (10) having a recoil spring guide (15) mounts components on the spring guide so that a light beam (18) is directed along the axis of the spring guide. This automatically makes light beam (18) parallel with the barrel (11) of firearm (10). Several mounting alternatives are possible, including a collimating lens (21) arranged on the axis of the spring guide to receive light from a laser diode (20) that is either mounted on the spring guide with the collimating lens or mounted remotely and arranged for directing light to collimating lens (21) via a fiber optic cable (25). These arrangements can also conceal the laser light within the firearm, where it is well protected and not noticeable.

18 Claims, 3 Drawing Sheets

RECOIL SPRING GUIDE MOUNTING FOR LASER SIGHT

BACKGROUND

Laser sights for firearms have been mounted outside the firearm—usually above the barrel in the position of a telescopic sight. There they encumber the firearm with a bulky and awkward accessory that inevitably gets in the way of other operations. The firearm is heavier, much more unwieldly, and does not holster readily. The laser sight is exposed to being knocked out of adjustment and is conspicuously noticeable, which is a disadvantage in some situations. Examples of such prior art laser sights, known to applicant and his attorney, are enclosed with an Information Disclosure Statement.

I have devised a way of combining a laser sight with a recoil spring guide of a firearm having a recoil spring. This is common in self-loading pistols and carbines based upon the inventions of John Browning, dating from around 1902. Recoil springs and spring guides are incorporated in modern blow back and linkage spring-delayed pistol actions of manufacturers including Colt, Browning, Sig Sauer, Berretta, Glock, Heckler & Koch, Smith & Wesson, and many others.

By using the recoil spring guide for mounting purposes, my invention can conceal all the necessary components of the laser sight within a firearm. Using a laser diode for producing the light beam helps make my laser sight compact, and housing some of the laser sight components within the recoil spring guide helps conceal the laser sight within the firearm and helps direct the light beam out on a path parallel with the barrel. My laser sight is also compact, lightweight, low cost, and effectively combined with such a firearm.

SUMMARY OF THE INVENTION

My laser sight applies to a firearm having a mechanism using a recoil spring guide, and the laser sight produces a beam of light parallel with the barrel of the firearm. It mounts an emanator of the beam on the spring guide so that the emanator directs the beam forward of the spring guide on an axis of the spring guide. It also includes a laser diode providing light for the beam, and the emanator includes a collimating lens receiving light from the laser diode. The collimating lens, or a reflector of the beam from the collimating lens, is mounted on the axis of the spring guide; and the laser diode can also be mounted on the spring guide axis, near the collimating lens. The spring guide can be a tube, and components of the emanator, with or without the laser diode, can be mounted in the tube. If the laser diode is mounted remotely, a fiber optic cable can transmit light to a collimating lens in the emanator. A preferred location for a battery for the power source for the laser diode is in a magazine for the firearm, and a preferred switch for turning the laser diode on and off is a gravity switch.

DRAWINGS

DETAILED DESCRIPTION

Figure 1:
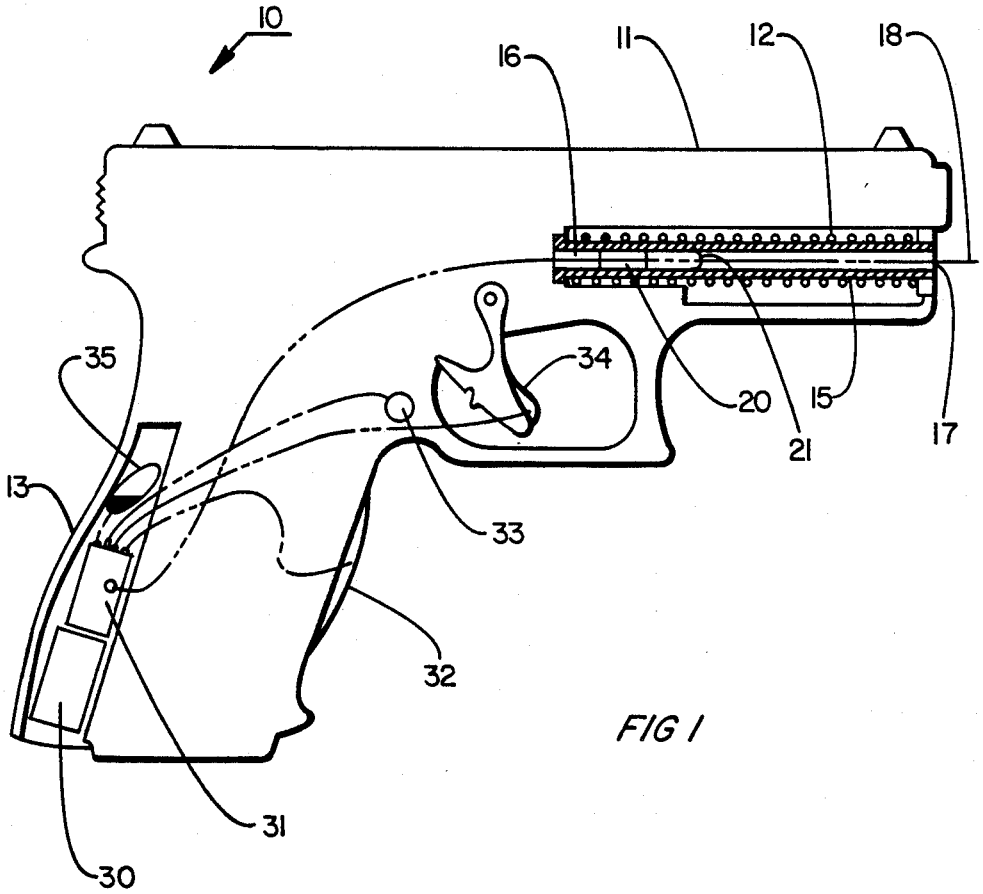
FIG. 1 is a schematic view of a preferred embodiment of my laser sight installed in a schematically illustrated pistol having a blow back mechanism using a recoil spring guide in the form of a tube.

Automatic and semiautomatic firearms often use a recoil compression spring and a recoil spring guide arranged inside or outside of the spring coils. The spring guide is usually a nonmoving part; and it is arranged parallel with the barrel of the firearm, within the path of movement of the recoil spring, to keep the spring from buckling. The spring guide normally has a hollow interior that I have recognized as a desirable place to mount components of a laser sight so that a light beam can be directed along the axis of the spring guide, which makes the light beam parallel with the barrel. The light beam can then proceed forward of the spring guide, to impinge on whatever the firearm is aimed at. The advantages of mounting laser sight components on a recoil spring guide can be achieved in several ways, including front mounts, rear mounts, internal mounts, and remote laser diode mounts, several preferred embodiments of which are illustrated in the drawings.

One preferred way of doing this is schematically applied to a semiautomatic pistol 10 as shown in FIG. 1. A pistol 10 has a blow back mechanism that includes a recoil spring guide tube 15 arranged parallel with barrel 11 and surrounded by a recoil spring 12. Spring tube 15 has a hollow interior 16 and an open forward end 17, both of which can be used for mounting laser sight components according to my invention.

Figure 3:
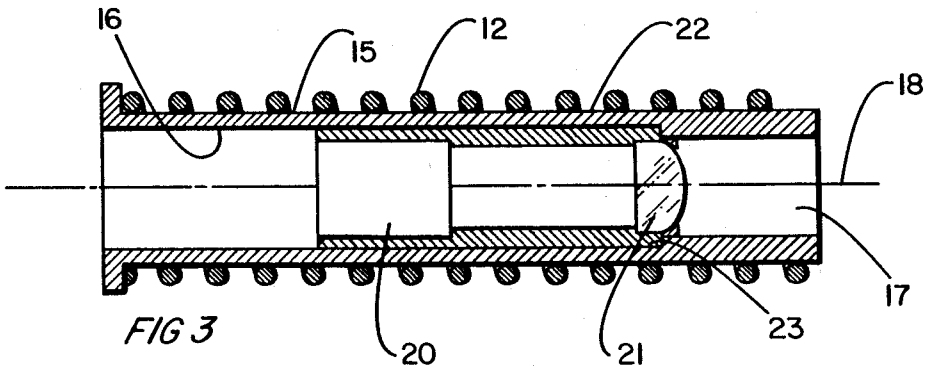
FIG. 3 is an enlarged and fragmentary schematic view of a recoil spring guide tube containing a laser diode and collimating lens, according to my invention.
Figure 4:
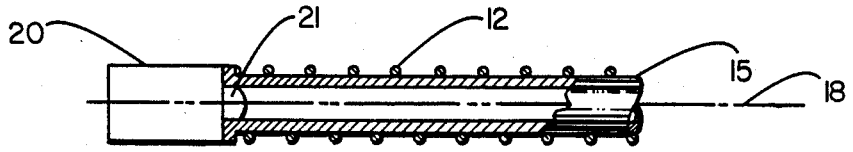
FIG. 4 is a partially schematic view of a recoil spring guide on the rear end of which a laser diode and collimating lens are mounted according to my invention.

A laser diode 20, along with a collimating lens 21, is arranged within hollow interior 16 of guide tube 15 to direct a light beam 18 out through open forward end 17 of guide tube 15. Laser diode 20 is a solid state device that is available in a size small enough to fit within hollow interior 16 of spring guide tube 15. Laser diode 20 can also fit elsewhere in pistol 10 and can emit either visible or infrared light. Collimating lens 21 is also generally available in a size small enough to fit within spring tube 15 in a position spaced forward of laser diode 20 by the focal length of lens 21, so that beam 18 is collimated and directed forward of pistol 10 and parallel with barrel 11. Since guide tube 15 is already parallel with barrel 11 in pistol 10, it is only necessary to mount laser diode 20 and lens 21 on the axis of guide tube 15, within hollow interior 16, to make light beam 18 parallel with barrel 11. As shown in FIG. 3, this can be done by arranging laser diode 20 and lens 21 in a subassembly 22 seated against a shoulder 23 formed within hollow interior 16 of guide tube 15. It can also be done, as shown in FIG. 4, by mounting laser diode 20 and lens 21 at the rear end of spring tube 15 where these components are aligned with the axis of spring tube 15.

Figure 2A:
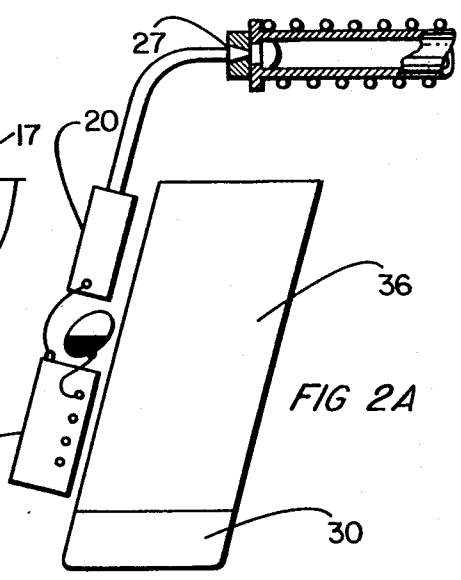
FIGS. 2 and 2A are schematic views, similar to the view of FIG. 1, showing other preferred embodiments of my laser sight intended for a pistol.
Figure 2:
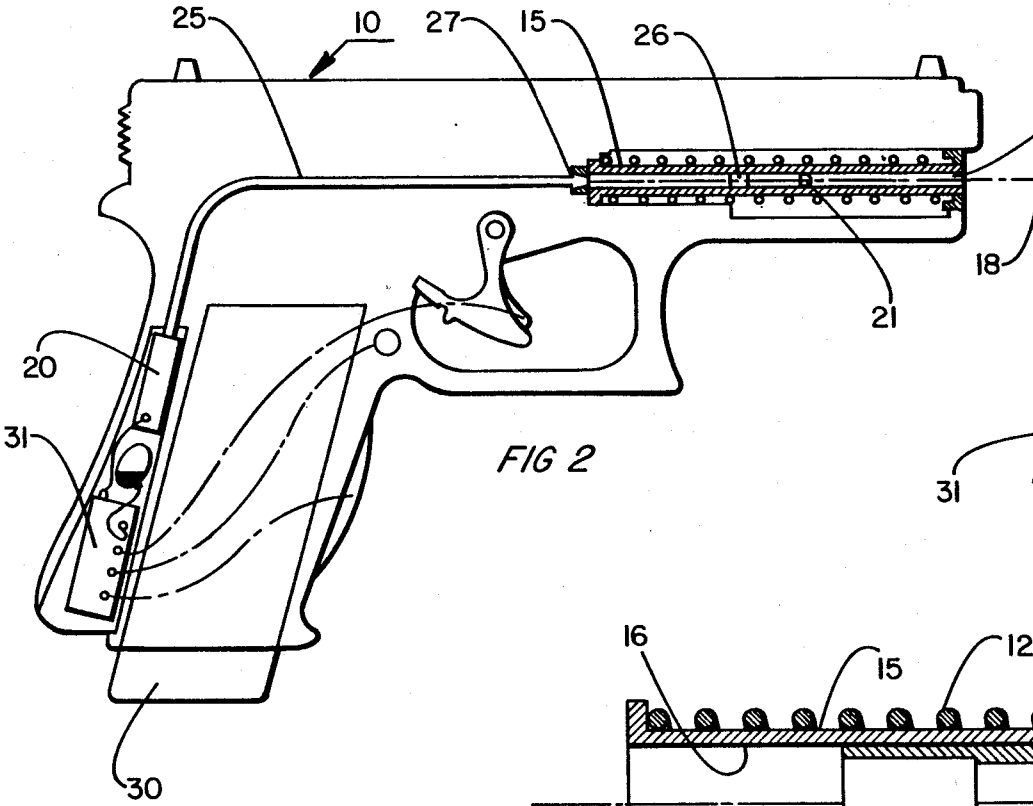

I have found that the components necessary for operating laser diode 20 can be concealed within pistol 10. Each firearm has a different structure and offers different possibilities for concealment of a battery 30, power circuitry 31, and a switch necessary for energizing laser diode 20 to produce light beam 18. As shown in FIG. 1, battery 30 and power circuitry 31 can conveniently be arranged within a grip 13 of pistol 10. Battery 30 can also be combined with a magazine for pistol 10, as shown in FIG. 2, so that each magazine can have a fresh battery, assuring power for laser diode 20. Many other locations are also possible for these components, depending on the structure of the particular firearm to which my laser sight is applied. Besides automatic and semiautomatic pistols, these can include carbines and other firearms using recoil springs and recoil spring guides.

A switch for turning laser diode 20 on and off can be arranged in any of several convenient ways on pistol 10. These are shown schematically as broken line alternatives in FIGS. 1 and 2; and they include grip switch 32, safety switch 33, trigger switch 34, and gravity switch 35. Grip switch 32 can be arranged anywhere around grip 13 so that it is closed whenever the user of pistol 10 has a hand hold on grip 13. Safety switch 33, if available on pistol 10, can be used to turn laser diode 20 on whenever safety switch 33 is released. Trigger switch 34, having a similar safety function on pistol 10, can be used to turn laser diode 20 on whenever the operator of pistol 10 has a finger pulling lightly on trigger switch 34.

Gravity switch 35 is arranged within pistol 10 to be closed whenever pistol 10 is leveled and to be open whenever pistol 10 is holstered. Since most firing is done with pistol 10 leveled, and most holstering is done with pistol 10 pointing downward, gravity switch 35 can be set at a suitable angle to distinguish between these conditions. Then pointing pistol 10 downward, as is done in holstering, opens gravity switch 35 and extinguishes laser diode 20; and leveling pistol 10 within a range of angles around the horizontal, as is done in shooting, closes gravity switch 35 and energizes laser diode 20. Gravity switch 35 can be a mercury switch or some other form of switch responsive to gravity.

A gravity switch can also be applied to firearms other than pistols, and "holstering" is intended in the broad sense of inactive storage, rather than in the literal sense of being inserted into a leather holster. For example, a gun storage rack within a police vehicle can be a form of holstering that stores a firearm in a vertical orientation that would open a gravity switch and extinguish laser diode 20. Other switches are also possible, and switches can be combined so that my laser sight can be turned on in more than one way.

Concealing my laser sight within a firearm and using a recoil spring guide for directing a light beam out from the firearm has several important advantages over the prior art mounting of a laser sight external to a firearm. No external mechanisms are in the way of handling and holstering the firearm or are required to be kept in adjustment against dislodgement from any bangs or bumps. The presence of the laser sight is invisible so that the bearer of the firearm does not become a target because of the conspicuous presence of a laser sight. My laser sight also does not add appreciably to the weight of the firearm or in any way impair its normal operation. Police, who are the principal users of laser sights, will appreciate these advantages over an externally mounted laser sight.

FIG. 2 illustrates remote mounting of laser diode 20 and a fiber optic cable 25 leading from laser diode 20 to spring tube 15 of pistol 10. Light from laser diode 20 then passes via fiber optic cable 25 to a terminal end 26 of cable 25 spaced from collimating lens 21, as schematically illustrated. Lens 21 then directs light from the terminal end 26 of fiber optic cable 25 out through the open forward end 17 of spring tube 15, as previously explained. A fiber optic jack 27, arranged near the rear end of spring tube 15, is desirable to allow easy disconnection of fiber optic cable 25. As previously mentioned, battery 30 is combined with magazine 36 in the embodiment of FIG. 2, so that magazine changes also change battery 30, and so that a battery can be changed more easily by removing magazine 36.

Since frames and grips of pistols and other firearms are often made of plastic, it is possible according to my invention to embed conductive wires or a fiber optic cable within a firearm frame as it is molded. This can make the firearm ready to receive my laser sight, simply by adding battery 30, power circuitry 31, the necessary switch, and a lens and a laser diode or fiber optic cable. My laser sight can also be added to existing pistols and other firearms without requiring any extensive reconstruction.

Figure 5:
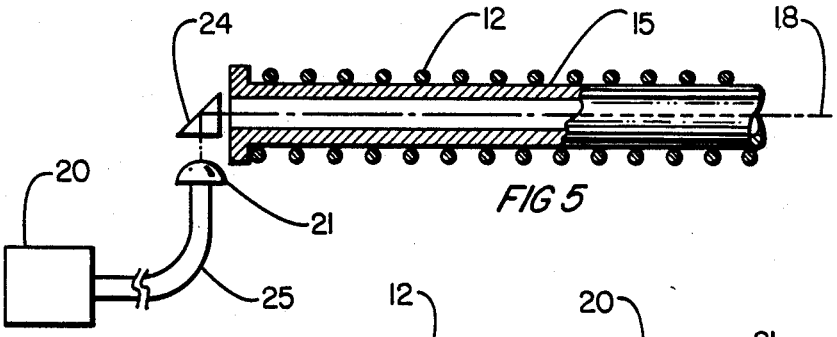
FIG. 5 is a partially schematic view of a recoil spring guide mounting a reflector and collimating lens for directing a light beam from a laser diode according to my invention.

FIG. 5 shows the possibility of mounting collimating lens 21 off the axis of recoil spring guide 15, with a reflector 24 mounted on the axis of spring guide 15 so that beam 18 is directed along the axis of spring guide 15, as desired. Reflector 24 is preferably mounted so as not to rotate, so that beam 18 aligns accurately with the axis of spring guide 15. A fiber optic cable 25 from a remote laser diode 20 can direct light to collimating lens 21, and a fiber optic jack can be arranged in cable 25, if desired.

Figure 6:
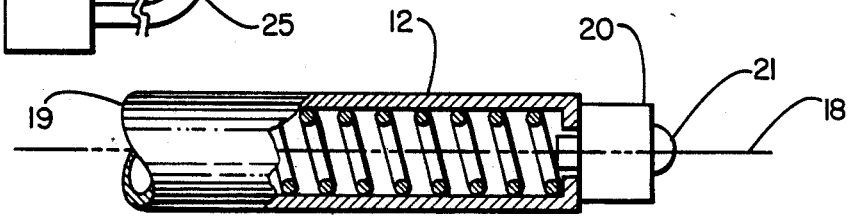
FIG. 6 is a partially schematic view of a different form of recoil spring guide on a forward end of which a laser diode and collimating lens are mounted according to my invention.

FIG. 6 schematically shows a different form of recoil spring guide 19 surrounding recoil spring 12. A laser diode 20 is mounted on a forward end of spring guide 19 and arranged so that collimating lens 21 directs beam 18 forward on the axis of spring guide 19. This takes advantage of the parallelism between the axis of spring guide 19 and the axis of the barrel of the firearm by mounting the laser sight on the axis of the spring guide, but the light beam 18 does not pass through the hollow interior of spring guide 19, as is done in internal or rear mounts. A front mount can expose laser diode and collimating lens 21 to view at the forward end of the firearm, but the preferred small size of these components makes them relatively inconspicuous, even in such an exposed location.

Figure 7:
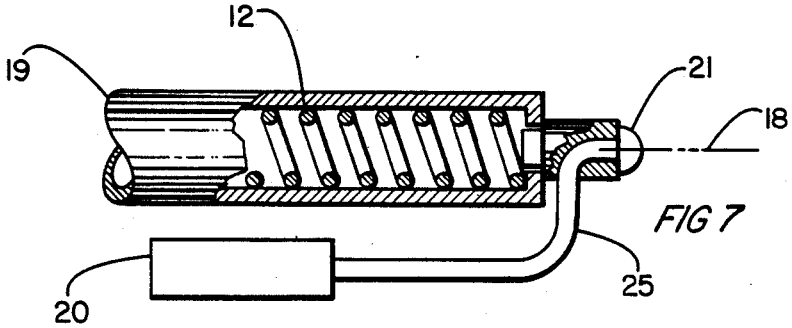
FIG. 7 is a partially schematic view of a recoil spring guide having a collimating lens mounted on a forward end and a fiber optic cable transmitting light to the collimating lens from a remote laser diode according to my invention.

Another forward mount is schematically shown in FIG. 7, involving a remotely located laser diode 20, a fiber optic cable 25, and a collimating lens 21 mounted on the forward end of a spring guide 19. Collimating lens 21 can also be mounted internally or toward the rear of a recoil spring guide, as is apparent from other illustrated embodiments.

Figure 8:
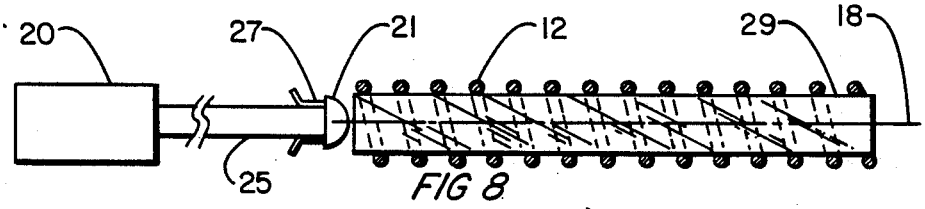
FIG. 8 is a partially schematic view of a spring guide formed as a transparent rod through which a light beam is passed according to my invention.

Spring guide 29 of the embodiment of FIG. 8 is a transparent rod of glass or plastic that also serves as a guide for recoil spring 12. Although guide 29 does not have a hollow interior, it transmits light beam 18 along its axis from a rear mounted collimating lens 21. Laser diode 20 can also be rear mounted, with lens 21, or can be remotely mounted, using a fiber optic cable 25, as illustrated in FIG. 8.

Features of the illustrated embodiments can be intermixed, showing that a large variety of mounts for laser diodes and collimating lenses are possible relative to a recoil spring guide. The emanator of the light beam from the laser diode is arranged on the axis of the spring guide, preferably by mounting collimating lens 21 or a reflector 24, on the spring guide axis, so that the light beam 18 proceeds along the spring guide axis. This assures parallelism with the barrel of the firearm and simplifies and protects the mounting of my laser sight. This can be completely concealed or inconspicuously visible, depending on the mounting alternatives selected.

I claim:

1. A firearm having a laser sight and a mechanism using a recoil spring guide, said firearm comprising:

a. A laser diode mounted in a concealed position within said firearm;

b. a collimating lens arranged for collimating a beam of light from said laser diode; and c. said collimating lens being mounted to direct said beam forward of said spring guide on said axis of said spring guide, so that said beam is thereby parallel with the barrel of said firearm.

2. The firearm of claim 1 wherein said collimating lens is mounted on said spring guide.

3. The firearm of claim 1 wherein a reflector is mounted on said spring guide for directing said beam from said collimating lens along said axis of said spring guide.

4. The firearm of claim 1 wherein said spring guide is a tube and said collimating lens is mounted within said tube.

5. The firearm of claim 1 wherein said laser diode is mounted remotely from said spring guide, and a fiber optic cable is arranged for directing said light from said laser diode to said collimating lens.

6. The firearm of claim 1 wherein said laser diode and said collimating lens are both mounted on said spring guide.

7. The firearm of claim 1 including a battery, switch, and power circuitry for energizing said laser diode.

8. The firearm of claim 7 wherein said battery is arranged on a magazine for said firearm.

9. The firearm of claim 7 wherein said switch is a gravity switch that energizes said laser diode when said firearm is leveled and deenergizes said laser diode when said firearm is holstered.

10. In a firearm having a laser sight system and a recoil spring guide, said laser sight system producing a beam of light parallel with the barrel of said firearm, the improvement comprising:

a. an emanator of said beam being mounted on said spring guide so that said emanator directs said beam forward of said spring guide on an axis of said spring guide;

b. a laser diode providing light for said beam; and c. said emanator including a collimating lens receiving light from said laser diode.

11. The improvement of claim 10 including a fiber optic cable arranged for transmitting light from said laser diode to said collimating lens.

12. The improvement of claim 10 wherein said emanator includes a reflector arranged on said axis of said spring guide.

13. The improvement of claim 10 wherein said collimating lens is arranged on said axis of said spring guide.

14. The improvement of claim 10 wherein said laser diode is mounted on said spring guide.

15. The improvement of claim 10 wherein said emanator is mounted within said spring guide and concealed within said firearm.

16. The improvement of claim 10 including a battery, switch, and power circuitry for energizing said laser diode.

17. The improvement of claim 16 wherein said battery is arranged on a magazine for said firearm.

18. The improvement of claim 16 wherein said switch is a gravity switch that energizes said laser diode when said firearm is leveled and deenergizes said laser diode when said firearm is holstered.

* * * * *